US010463981B1

(12) United States Patent
Brister et al.

(10) Patent No.: US 10,463,981 B1
(45) Date of Patent: Nov. 5, 2019

(54) RIDE VEHICLE ELEVATOR AND MOTION ACTUATION

(71) Applicant: Universal City Studios LLC, Universal City, CA (US)

(72) Inventors: Michael Keith Brister, Winter Garden, FL (US); Clarisse Marie Vamos, Orlando, FL (US); Michael Joseph Tresaugue, Windermere, FL (US)

(73) Assignee: UNIVERSAL CITY STUDIOS LLC, Universal City, CA (US)

( * ) Notice: Subject to any disclaimer, the term of this patent is extended or adjusted under 35 U.S.C. 154(b) by 0 days.

(21) Appl. No.: 16/234,046

(22) Filed: Dec. 27, 2018

(51) Int. Cl.

| | |
|---|---|
| ***A63G 31/02*** | (2006.01) |
| ***B66B 9/00*** | (2006.01) |
| *A63G 31/00* | (2006.01) |

(52) U.S. Cl.
CPC ..... *A63G 31/02* (2013.01); *B66B 9/003* (2013.01); *A63G 2031/002* (2013.01)

(58) Field of Classification Search
CPC .. A63G 2031/002; A63G 31/00; A63G 31/10; A63G 31/16; A63G 31/02; B66B 3/00; B66B 9/00; B66B 9/003
USPC ..... 472/2, 49–50, 59, 60, 130, 136; 187/414
See application file for complete search history.

(56) References Cited

U.S. PATENT DOCUMENTS

| | | | | |
|---|---|---|---|---|
| 5,618,149 | A | 4/1997 | Beaumont et al. | |
| 6,076,638 | A * | 6/2000 | Gertz | B66B 3/00 187/414 |
| 6,490,979 | B1 | 12/2002 | Pfleger et al. | |
| 7,665,582 | B2 * | 2/2010 | Lindh | B66B 9/187 182/2.1 |
| 8,795,096 | B2 * | 8/2014 | Stoker | A63J 21/00 472/71 |
| 2013/0145953 | A1 | 6/2013 | Crawford et al. | |
| 2014/0200087 | A1 * | 7/2014 | Vatcher | A63G 31/02 472/131 |

OTHER PUBLICATIONS

Schilling, David, "Engineering Disney's "Tower of Terror" Ride", Website: http://www.industrytap.com/engineering-disneys-tower-of-terror-ride/5209, Feb. 3, 2015, pp. 1-6.

* cited by examiner

*Primary Examiner* — Kien T Nguyen
(74) *Attorney, Agent, or Firm* — Fletcher Yoder, P.C.

(57) ABSTRACT

An attraction system includes an elevator assembly having an elevator path that intersects a ride path of the attraction system, an elevator car having a support and configured to travel along the elevator path, a ride vehicle having a cabin coupled to a bogie, and a cabin projection of the cabin. The ride vehicle is configured to travel along the ride path via the bogie, in which the bogie is configured to travel into the elevator car via the ride path, and the support is configured to capture the cabin projection on at least two sides when the ride vehicle is in a loaded position.

20 Claims, 8 Drawing Sheets

RIDE VEHICLE ELEVATOR AND MOTION ACTUATION

BACKGROUND

The disclosure relates generally to an amusement park attraction, and more specifically, to an elevator system that may transport a ride vehicle of the amusement park attraction.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Amusement parks include a variety of features to entertain guests of the amusement park. For example, the amusement park may include attractions having a ride vehicle that carries the guests. The ride vehicle may move along a ride path of the attraction to generate certain sensations experienced by the guest. For some attractions, vertical transport systems (e.g., elevators, lifts, or other systems) may be used to transport the ride between levels of the attraction or otherwise control the elevation of the ride vehicle. However, the ability to create certain sensations by the guest as the ride vehicle is transported between levels may be constrained by a structure of the vertical transport systems. As a result, a guest experience related to the change in elevation of the ride vehicle may be limited.

BRIEF DESCRIPTION

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, an attraction system includes an elevator assembly having an elevator path that intersects a ride path of the attraction system, an elevator car having a support and configured to travel along the elevator path, a ride vehicle having a cabin coupled to a bogie, and a cabin projection of the cabin. The ride vehicle is configured to travel along the ride path via the bogie, in which the bogie is configured to travel into the elevator car via the ride path, and the support is configured to capture the cabin projection on at least two sides when the ride vehicle is in a loaded position.

In another embodiment, a method of operating an attraction system includes actuating, via a motion base, a cabin of a ride vehicle relative to a bogie of the ride vehicle, in which the motion base is disposed between the cabin and the bogie, and in which the cabin has a cabin projection and the bogie has a bogie projection. The method further includes directing the bogie along a ride path of the attraction system to engage the bogie projection with guides of an elevator car, and actuating, via the motion base, the cabin to engage the cabin projection with a support of the elevator car, in which the ride vehicle is in a loaded position while the support captures the cabin projection on at least two sides.

In another embodiment, a controller of an attraction system includes a tangible, non-transitory, computer-readable medium having computer-executable instructions stored thereon that, when executed, cause a processor to actuate, via a motion base, a cabin of a ride vehicle relative to a bogie of the ride vehicle, in which the motion base is disposed between the cabin and the bogie, and in which the cabin has a cabin projection and the bogie has a bogie projection. The instructions, when executed, further cause the processor to direct the bogie along a ride path of the attraction system to engage the bogie projection with guides of an elevator car, and actuate, via the motion base, the cabin to engage the cabin projection with a support of the elevator car, in which the ride vehicle is in a loaded position while the support captures the cabin projection on at least two sides.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Amusement parks include attractions with a variety of features to entertain guests. For example, the amusement park may include attractions having a ride vehicle that carries the guests along a ride path to generate certain sensations experienced by the guest. The ride path may include different configurations, such as loops, curves, hills, and so forth, that cause the ride vehicle to travel in a particular manner, which may impose certain motions of the guests in the ride vehicle. In general, movement of the ride vehicle along the ride path may entertain guests on the ride vehicle. Additionally, an amusement park attraction designer may wish to design an attraction system that may move the ride vehicle within an elevator as the ride vehicle is transported between different levels of the attraction by the elevator. However, the ability to create certain sensations by the guest as the ride vehicle is transported between levels may be constrained by a structure of existing ride paths.

Therefore, it is presently recognized that an attraction system having an elevator assembly configured to receive a ride vehicle and transport the ride vehicle to different levels of the attraction system while creating a sensation of being pitched forward for guests disposed within the ride vehicle, may enhance the guest experience of the attraction system. The elevator assembly may include an interface that enables easy entry and/or exit of the ride vehicle relative to the elevator assembly. Furthermore, the interface supports the ride vehicle as the attraction system pitches the ride vehicle and as the elevator assembly transports ride vehicle.

Figure 1:
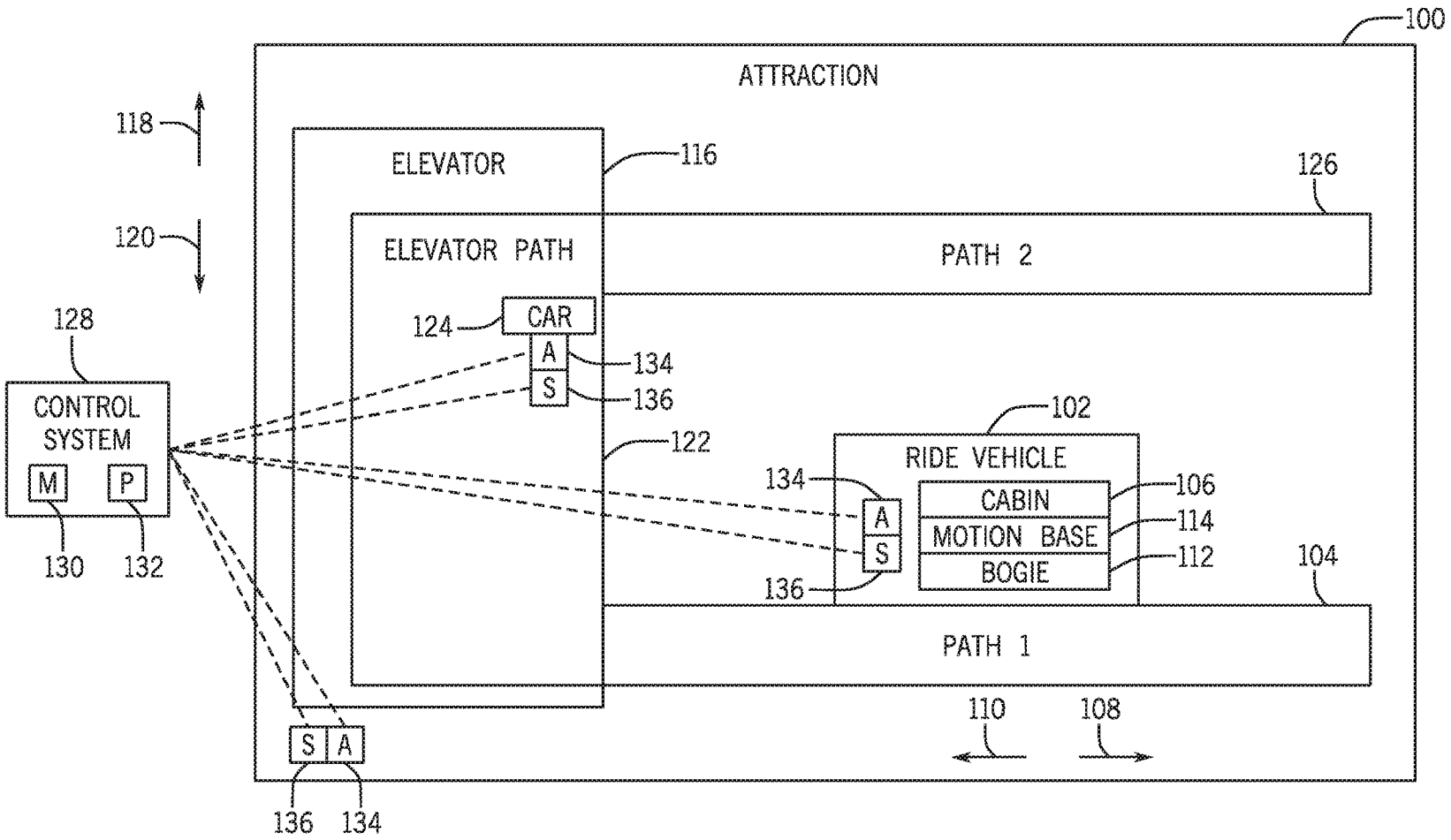
FIG. 1 is a schematic of an embodiment of an attraction system having a ride vehicle and an elevator assembly, including an elevator car that receives the ride vehicle, in accordance with aspects of the present disclosure.

Turning now to the drawings, FIG. 1 is a schematic view of an embodiment of an attraction system 100 that may be implemented in an amusement park. The attraction system 100 includes a ride vehicle 102 configured to travel (e.g., translate) along a first path 104. As used herein, a "ride vehicle" may include any device and/or assembly configured to hold and transport guests of the amusement park. For example, the ride vehicle 102 may include a cabin 106 in which guests may enter. The guests may be enclosed within the cabin 106 while the ride vehicle 102 is in motion. As an example, the ride vehicle 102 may travel in a first direction 108 and/or a second direction 110 along the first path 104. As will be appreciated, traveling of the ride vehicle 102 may enhance a guest's experience in the attraction system 100. In one embodiment, the ride vehicle 102 may include a bogie 112. By way of example, the bogie 112 may be a cart having wheels to enable the buggy to travel along the first path 104. In a non-limiting embodiment, the first path 104 may be a track to which the bogie 112 is directly coupled to enable the bogie 112 to guide along the first path 104. Additionally or alternatively, the first path 104 may be a route along which the bogie 112 may travel. For example, the bogie 112 may be a self-driving vehicle programmed to travel along the first path 104. In one embodiment, the ride vehicle 102 may include a motion base 114 disposed between the cabin 106 and the bogie 112. The motion base 114 may be configured to move the cabin 106 relative to the bogie 112 (e.g., heave, surge, turn, yaw, pitch, roll, extend, retract). To this end, the motion base 114 may be a Stewart platform, a parallel linkage assembly, a ball and socket assembly, or any combination thereof. In one example, as the ride vehicle 102 travels along the first path 104, the motion base 114 may move the cabin 106 relative to the bogie 112. Movement of the cabin 106 relative to the bogie 112 as the ride vehicle 102 travels along the first path 104 may induce certain sensations felt by the guests (e.g., weightlessness). In one embodiment, the attraction system 100 may be considered a ride system in which the ride vehicle 102 primarily travels in a particular manner to entertain guests, such as at a certain speed along the first path 104. In an additional or alternative embodiment, the attraction system 100 may be considered a show system and may include performers, show elements, and other show effects to entertain guests.

As shown in FIG. 1, the first path 104 may be coupled to an elevator assembly 116 of the attraction system 100 or otherwise direct the ride vehicle 102 toward and/or away from the elevator assembly 116. The elevator assembly 116 provides the ride vehicle 102 with a method of travel that may be different from that provided by the first path 104. For instance, the elevator assembly 116 may include an elevator path 122 that enables the ride vehicle 102 to travel in a first vertical direction 118 and/or a second vertical direction 120 between levels or sections of the attraction system 100. The elevator assembly 116 may include an elevator car 124 that is coupled to and/or is guided along the elevator path 122. The elevator car 124 may be configured to receive the ride vehicle 102. By way of example, the first path 104 may be coupled to the elevator path 122 or otherwise direct the ride vehicle 102 to the elevator car 124. After the elevator receives the elevator car 124, the elevator car 124 may travel along the elevator path 122 to transport the ride vehicle 102 to a different level or section of the attraction 100. In other words, the elevator car 124 may carry the ride vehicle 102 from the first path 104 to a different level or section of the attraction system 100 via the elevator path 122.

The attraction system 100 may include a second path 126 that is at a different level of the attraction 100 than the first path 104. The ride vehicle 102 may be configured to travel in the first direction 108 and/or the second direction 110 along the second path 126. The second path 126 may be coupled to the elevator path 122 or otherwise direct the ride vehicle toward and/or away from the elevator path 122. The elevator car 124 may be configured to travel along the elevator path 122 to the level of the second path 126 and enable the ride vehicle 102 to travel from the elevator path 122 to the second path 126. As such, the elevator assembly 116 may be configured to transport the ride vehicle 102 between the first path 104 and the second path 126. Although the illustrated embodiment depicts the attraction system 100 as having a first path 104 and a second path 126 connected to a single elevator path 122, it should be understood that the attraction system 100 may include any number of elevator assemblies 116, in which each elevator assembly 116 may include an elevator path 122 to which any number of paths, disposed at any number of respective levels, are connected. Moreover, the attraction system 100 may include any number of ride vehicles 102 and/or elevator cars 124 configured to travel along the respective paths.

The attraction system 100 may include and/or be communicatively coupled to a control system 128 configured to operate certain components of the attraction system 100. As an example, the control system 128 may be communicatively coupled with and configured to operate the ride vehicle 102 and/or the elevator car 124. The control system 128 may include a memory 130 and a processor 132. The memory 130 may be a mass storage device, a flash memory device, removable memory, or any other non-transitory computer-readable medium that includes instructions regarding control of the attraction system 100. The memory 130 may also include volatile memory such as randomly accessible memory (RAM) and/or non-volatile memory such as hard disc memory, flash memory, and/or other suitable memory formats. The processor 132 may execute the instructions stored in the memory 130 to operate the attraction system 100.

In a certain embodiment, the control system 128 may be communicatively coupled to one or more actuators 134 of the attraction system 100. For instance, the actuators 134 may be configured to move the elevator car 124, the ride vehicle 102, and/or other aspects of the attraction system 100 (e.g., show pieces, projectors, lighting effects, sound effects, etc.) when activated by the control system 128. That is, activation of the actuators 134 of the elevator car 124 may move the elevator car 124 in the first vertical direction 118 and/or the second vertical direction 120 along the elevator path 122. Additionally or alternatively, the actuators 134 of the elevator car 124 may control another aspect of the elevator car 124, such as a component within the elevator car 124 configured to secure the ride vehicle 102 within the elevator car 124. Similarly, activation of the actuators 134 of the ride vehicle 102 may move the ride vehicle 102 in the first direction 108 and/or the second direction 110 along the first path 104 and/or the second path 126. Moreover, the ride vehicle 102 may include actuators 134 that are configured to activate the motion base 114 to move the cabin 106 relative to the bogie 112.

The control system 128 may also be communicatively coupled to one or more sensors 136 disposed in the attraction system 100. The sensors 136 may be configured to detect a parameter and transmit the detected parameter to the control system 128. In response to the transmitted parameter, the control system 128 may operate the attraction system 100, such as the actuators 134, accordingly. In an example embodiment, the control system 128 may operate the attraction system 100 based on a pre-programmed motion or movement profile of the ride vehicle 102 and/or the elevator car 124. That is, the control system 128 may activate the actuators 134 based on a timing of the attraction system 100 in operation. To this end, the sensors 136 may detect a time and/or duration in which the attraction system 100 is in operation. In another example embodiment, the parameter may include a certain operating parameter of a component of the attraction system 100, such as a location or position of the elevator car 124 and/or the ride vehicle 102 (e.g., relative to one another, relative to the elevator path 122, relative to the first and/or second ride paths 104, 126), a speed of the elevator car 124 and/or the ride vehicle 102, another suitable parameter, or any combination thereof. To this end, the sensors 136 may include pressure sensors, position sensors, accelerometers, and the like, and the control system 128 may operate the attraction system 100 based on the detected operating parameter.

It should also be appreciated that the control system 128 may operate other components of the attraction system 100 using the actuators 134 and/or the sensors 136. As an example, the control system 128 may be configured to activate actuators that control cables, visual elements, audio elements, show pieces, and other show effects of the attraction system 100. Such components may or may not be included with one of the elements (e.g., the ride vehicle 102) described herein. Indeed, it should be understood that the actuators 134 may be configured to control other components and the sensors 136 may be configured to detect other parameters that are not described herein.

Figure 2:
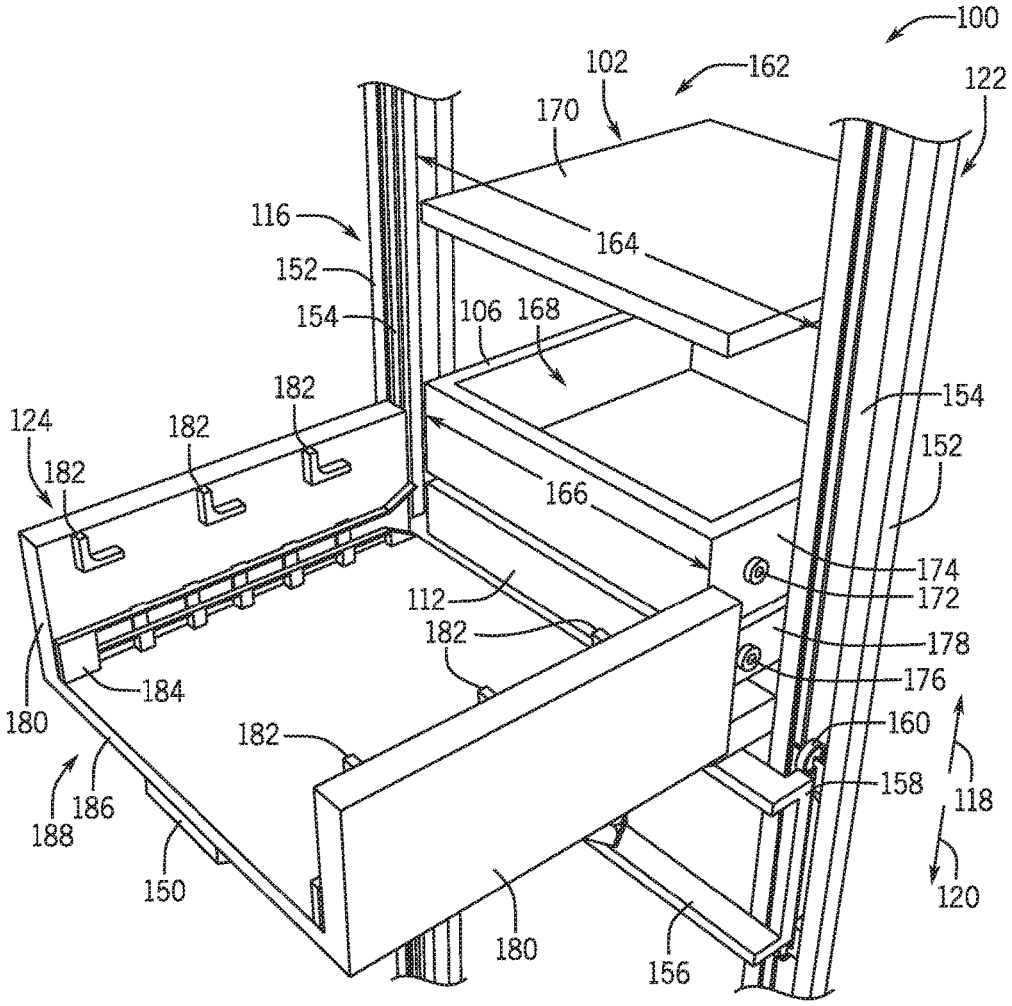
FIG. 2 is a perspective view of an embodiment of the attraction system of FIG. 1, in which the ride vehicle is adjacent to the elevator car, in accordance with aspects of the present disclosure.

FIG. 2 is a perspective view of an embodiment of the ride attraction system 100 of FIG. 1 illustrating the ride vehicle 102 approaching the elevator car 124. For instance, the ride vehicle 102 may be traveling along a path (e.g., the first path 104) outside of the elevator assembly 116. As shown in FIG. 2, the elevator car 124 may include an elevator base 150 configured to move the elevator car 124 along the elevator path 122. In the illustrated embodiment, the elevator path 122 may include two tracks 152, each including a recess 154. The elevator base 150 may include or be coupled to a frame 156 having flanges 158 configured to be received by each of the recesses 154 to couple the elevator base 150 and the elevator car 124 to the elevator path 122. Furthermore, the elevator car 124 may include elevator wheels 160 coupled to the flanges 158 to enable the elevator car 124 to travel along the elevator path 122 in the first vertical direction 118 and/or the second vertical direction 120. In a particular embodiment, the elevator car 124 may be locked at a position along the elevator path 122. As an example, the elevator wheels 160 may be configured to lock to restrict movement of the elevator wheels 160 along one or both tracks 152. In a further example, the frame 156 may include an additional component configured to lock and/or secure the frame 156 against the tracks 152 to substantially fix the elevator car 124 at a particular position along the elevator path 122.

As depicted in FIG. 2, the elevator assembly 116 may have an opening 162 that is sized and located to enable the ride vehicle 102 to travel into and out of the elevator car 124. For example, the opening 162 may be disposed between the tracks 152, in which the two tracks 152 span a distance 164 from one another that is wider than a width 166 of the ride vehicle 102. Additionally, the elevator car 124 may be positioned substantially level with the opening 162 and the ride vehicle 102 to permit the ride vehicle 102 to travel into and out of the elevator car 124.

As further shown in FIG. 2, the cabin 106 of the ride vehicle 102 may include an indentation 168 in which guests may be located while the attraction system 100 is in operation. In one embodiment, the cabin 106 may also include a roof 170 that extends atop the indentation 168, such as to cover the guests in the indentation 168. The ride vehicle 102 may further include cabin projections 172 (wheels, rollers, stops, detents, protrusions) disposed on a cabin sidewall 174 of the cabin 106 and/or bogie projections 176 disposed on a bogie sidewall 178 of the bogie 112. In a particular embodiment, the cabin projections 172 may be a wheel that moves about the bogie 112 (e.g., rotate). In another embodiment, the cabin projections 172 may be stationary. The cabin projections 172 and/or the bogie projections 176 may enable the ride vehicle 102 to be captured by, and, in some cases, supported by, the elevator car 124. For example, the elevator car 124 may include elevator car sidewalls 180, in which each elevator car sidewall 180 includes supports 182 and/or a guide 184. Each support 182 may be a bracket, a protrusion, or the like, configured to engage or capture a respective cabin projection 172 of the cabin 106. Furthermore, each guide 184 is configured to engage or capture bogie projections 176 of the bogie 112. Although this disclosure primarily refers to the cabin 106 and the bogie 112 as having cabin projections 172 and bogie projections 176, respectively, that may be configured to move (e.g., rotate) with respect to the ride vehicle 102, it should be understood that in an additional or an alternative embodiment, the cabin 106 and/or the bogie 112 may include stationary components, such as flanges, brackets, projections, and the like, configured to engage the supports 182 and engage the guide 184, respectively.

In the illustrated embodiment, the cabin 106 and the bogie 112 each have a substantially rectangular shape and the elevator car 124 also has a substantially rectangular shape to match the cabin 106 and the bogie 112. In particular, the elevator car sidewalls 180 extend from a foundation 186 of the elevator car 124 to form a U-shaped cross-section. In this manner, the ride vehicle 102 may be enclosed by the elevator car 124 such that the elevator car sidewalls 180 may abut or be positioned adjacent to the cabin projections 172 and/or the bogie projections 176. Moreover, in one embodiment, the bogie 112 may abut and be supported by the foundation 186.

Furthermore, FIG. 2 depicts that a side 188 of the elevator car 124 does not include the elevator car sidewall 180, but it should be understood that in an additional or alternative embodiment, the elevator car 124 may also include the elevator car sidewall 180 extending across the side 188. In this manner, when the bogie 112 is inserted into the elevator car 124, the cabin 106 may also abut the elevator car sidewall 180 on the side 188. Additionally, as should be appreciated, various embodiments of the attraction system 100 may include the cabin 106 and the bogie 112 having any suitable shape. Accordingly, the attraction system 100 may also include the elevator car 124 having a shape that may match that of the cabin 106 and the bogie 112.

Figure 3:
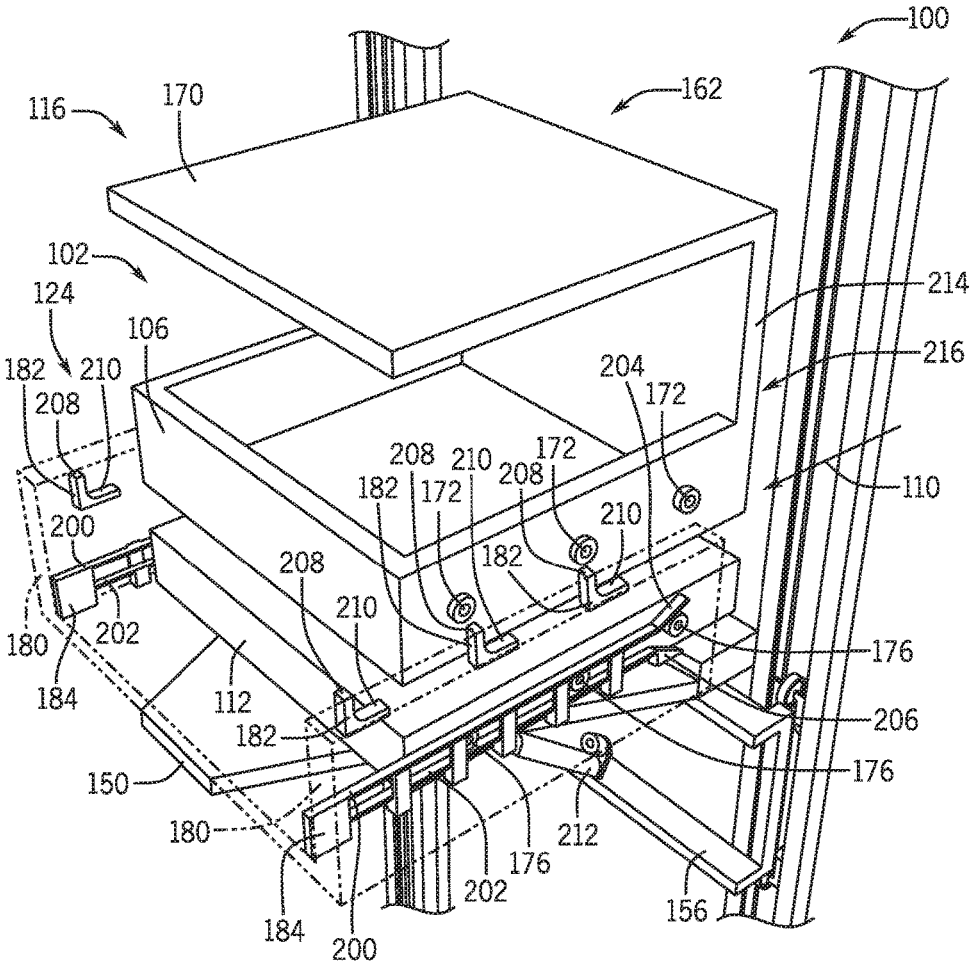
FIG. 3 is a perspective view of an embodiment of the attraction system of FIGS. 1 and 2, in which the elevator car receives the ride vehicle, in accordance with aspects of the present disclosure.

FIG. 3 is a perspective view of the attraction system 100 in which the ride vehicle 102 is entering the elevator car 124. In FIG. 3, the elevator car 124 is transparent to illustrate the components of the attraction system 100 clearly. As seen in the illustrated embodiment, the guides 184 of the elevator car 124 each include a first rail 200 and a second rail 202, in which the first rail 200 and the second rail 202 are offset and extend generally parallel to one another. When the ride vehicle 102 enters the elevator car 124, the bogie projections 176 may insert between the first rail 200 and the second rail 202. As such, the first rail 200 and the second rail 202 may capture the bogie projections 176 such that the bogie 112 is secured within the elevator car 124. To facilitate inserting the bogie projections 176 between the first rail 200 and the second rail 202, the first rail 200 may include a first end 204 and the second rail 202 may include a second end 206, in which the first end 204 and the second end 206 may be angled away from one another to increase an opening between the first rail 200 and the second rail 202. As such, the first end 204 and the second end 206 may guide the bogie projections 176 into the guide 184.

As further illustrated in FIG. 3, each support 182 may include a first portion 208 and a second portion 210, in which the first portion 208 and the second portion 210 may extend at an angle with one another along the respective elevator car sidewalls 180. For instance, the first portion 208 may be substantially perpendicular to the second portion 210. However, in an additional or an alternative embodiment, the first portion 208 may be substantially oblique to the second portion 210. In a sample embodiment, one of the supports 182 may be shaped in a different manner, such as having an additional portion to be in a U-shape configuration. In FIG. 3, each support 182 is disposed in substantially the same orientation and each support 182 is positioned to be generally aligned with one another. As such, the cabin 106 may be adjusted to avoid contact with the supports 182 as the ride vehicle 102 is entering the elevator car 124. In the illustrated embodiment, the cabin 106 may be lifted (e.g., by the motion base) such that the cabin projections 172 clear the first portion 208 of each support 182 as the ride vehicle 102 enters the elevator car 124. As such, the respective first portions 208 are no longer in a path of travel (e.g., in the second direction 110) of the cabin projections 172 as the ride vehicle 102 enters the elevator car 124. As an example, the ride vehicle 102 of FIG. 3 may include the motion base 114 of FIG. 1 (not shown) configured to move the cabin 106 away from the bogie 112 to enable the cabin 106 to be inserted into the elevator car 124 without obstruction from the supports 182.

In an example embodiment, the elevator assembly 116 may further include an elevator actuator 212 that generally supports the elevator base 150 against the frame 156. That is, the elevator actuator 212 may control an angle at which the elevator base 150 is positioned relative to the frame 156. By adjusting the angle of the elevator base 150 relative to the frame 156, the elevator actuator 212 may also adjust an angle at which the bogie 112 is positioned with respect to the frame 156. The elevator actuator 212 may be configured to activate to place the elevator base 150 at an angle such that the bogie 112 may enter into or exit out of the elevator car 124 at a particular angle. For instance, the elevator actuator 212 may place the elevator base 150 at an angle that matches an angle of a path connected to the opening 162. As described in more detail herein, the elevator actuator 212 may also be used to control the pitch of the elevator car 124 to create the sensation of pitching for guests disposed in the cabin 106.

In the illustrated embodiment, the roof 170 is connected to a remainder of the cabin 106 via a wall 214 at a side 216 of the cabin 106. However, the roof 170 may not be connected to the cabin 106 at remaining sides of the cabin 106. In this manner, guests within the cabin 106 may generally be able to view outside of the cabin 106. Additionally or alternatively, the wall 214 may include openings that further enable the guests to view outside of the cabin 106. As such, guests may be able to view elements that may be disposed within the elevator assembly 116 and/or elsewhere in the attraction system 100.

Figure 4:
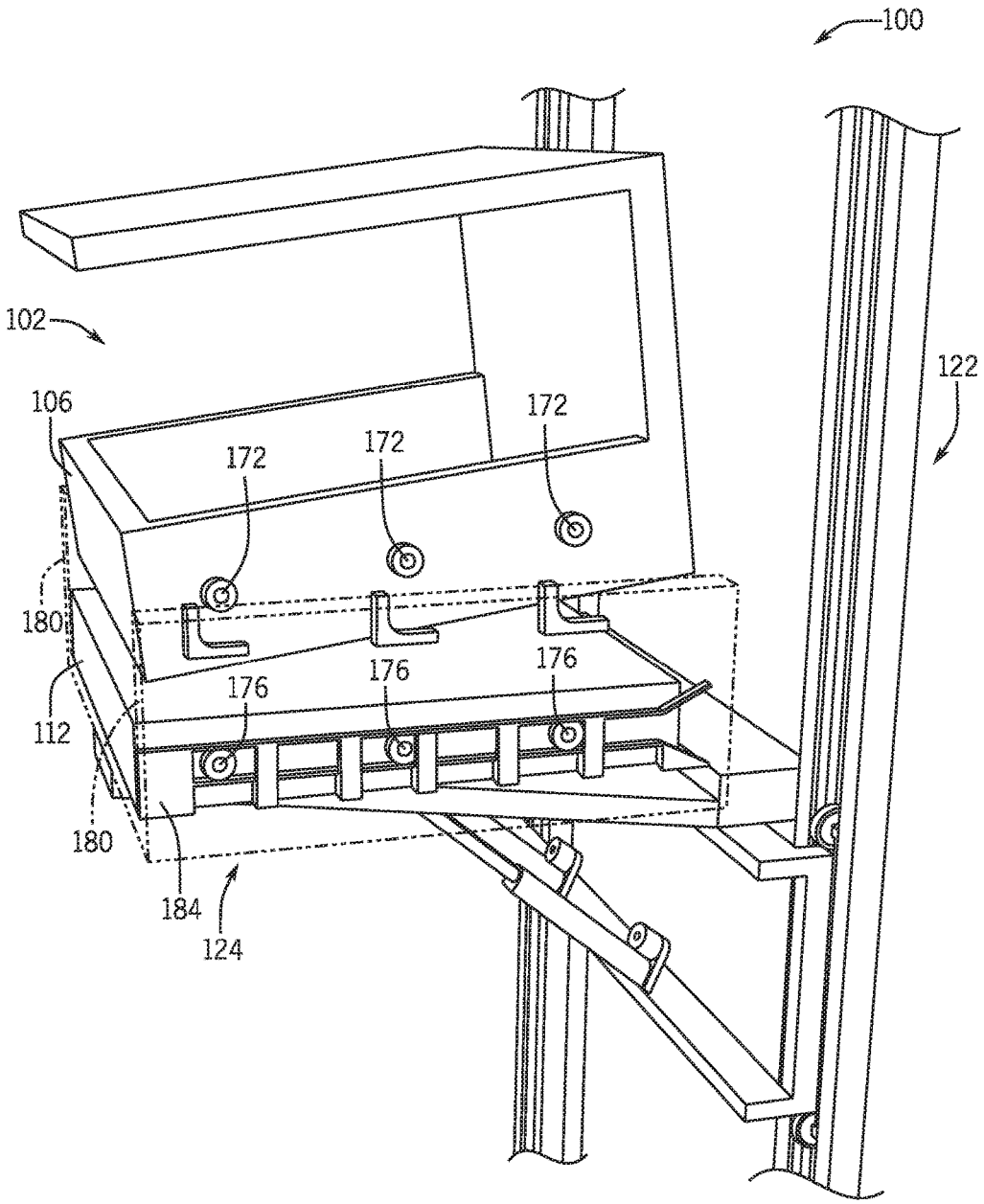
FIG. 4 is a perspective view of an embodiment of the attraction system of FIGS. 1-3, in which the ride vehicle actuates as the elevator car receives the ride vehicle, in accordance with aspects of the present disclosure.

FIG. 4 is a perspective view of an embodiment of the attraction system 100 in which the bogie 112 may be fully received by the elevator car 124 and in which the bogie projections 176 may be fully engaged with the guides 184 of the elevator car 124. In other words, all of the bogie projections 176 of the bogie 112 may be fully inserted within the respective guides 184. While the bogie 112 is fully received by the elevator car 124, the motion base 114 (disposed between the cabin 106 and the bogie 112, but not visible in FIG. 4) may still actuate and move the cabin 106 relative to the bogie 112. In the instant embodiment, the motion base 114 is retracting to bring the cabin 106 toward the bogie 112 such that each of the cabin projections 172 is disposed within an angle created by the respective supports 182. For instance, the motion base 114 actuates the cab through a "heaving" motion such that the cabin 106 pitches relative to the bogie 112 as the motion base 114 after the cabin projections 172 have cleared the supports 182 to controllably engage the cabin projections 172 with the supports 182. However, in another embodiment, the motion base 114 may actuate the cabin 106 such that the cabin 106 only moves vertically relative to the bogie 112 and the cabin 106 and the bogie 112 remain substantially parallel to one another.

While the bogie 112 is fully inserted into the elevator car 124, the motion base 114 may still be able to move the cabin 106 relative to the bogie 112. In other words, although the bogie 112 may be substantially stationary within the elevator car 124 and although the elevator car 124 may be substantially stationary on the elevator path 122, the cabin 106 may be moved about the bogie 112 to induce movement sensations on the guests. That is, the cabin 106 may rotate, pitch, yaw, turn, extend, retract, and so forth, relative to the stationary bogie 112 while the ride vehicle 102 remains within the elevator car 124. In an embodiment, the motion base 114 may extend the cabin 106 away from the bogie 112 such that the cabin projections 172 are clear of (e.g., above) the elevator car sidewalls 180. In this manner, the cabin projections 172 avoid contact with the elevator car sidewalls 180 when the cabin 106 is moved (e.g., pitch, surge, heave) about the bogie 112. In an additional or an alternative embodiment, the motion base 114 may extend the cabin 106 away from the bogie 112 such that the entire cabin 106 is clear of (e.g., above) the elevator car sidewalls 180. In this manner, the cabin 106 avoids contact with the elevator car sidewalls 180 when the cabin 106 performs yaw, sway, and/or roll maneuvers.

Figure 5:
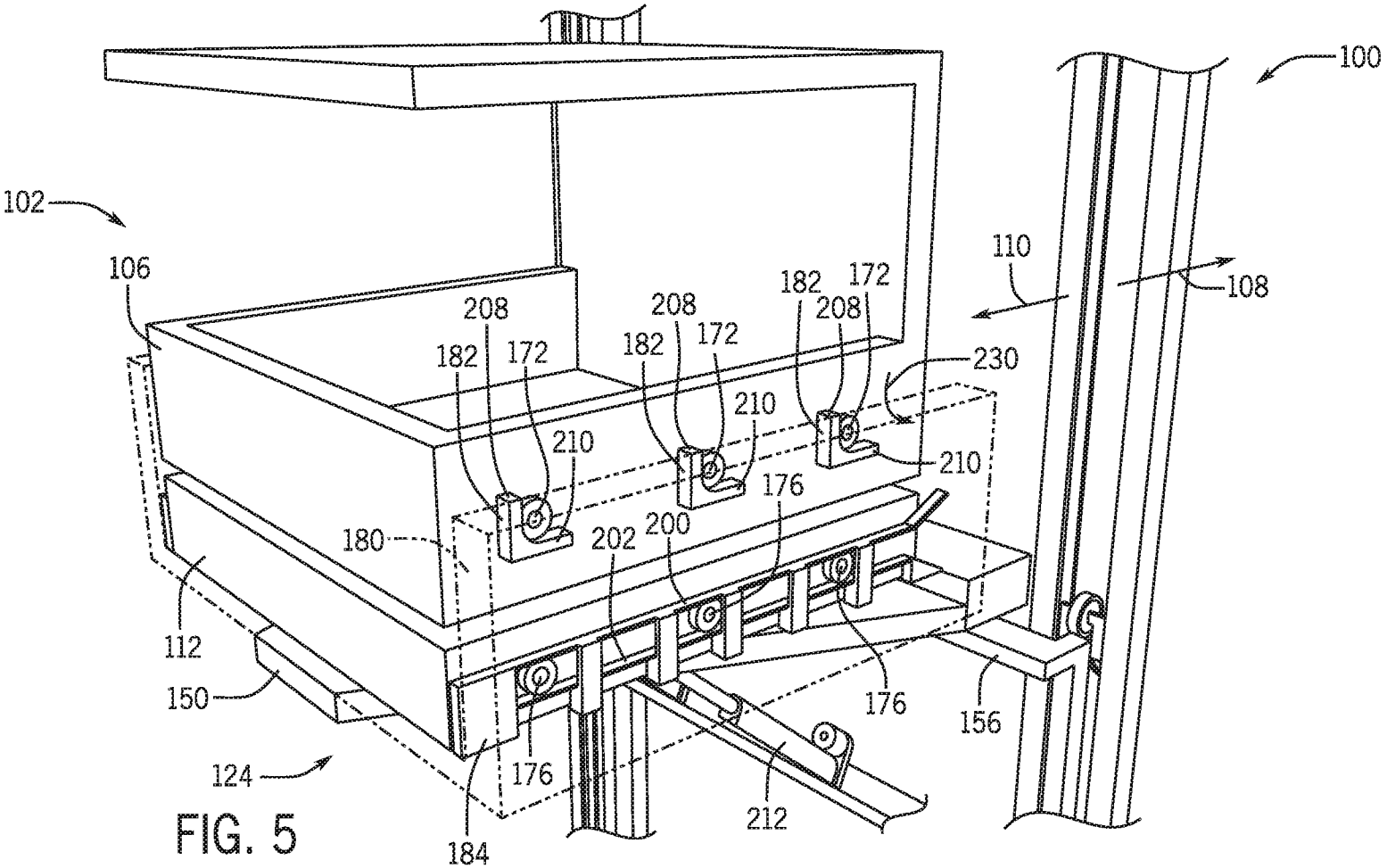
FIG. 5 is a perspective view of an embodiment of the attraction system of FIGS. 1-4, in which the ride vehicle is in a loaded position within the elevator car, in accordance with aspects of the present disclosure.

FIG. 5 is a perspective view of an embodiment of the attraction system 100 in which the ride vehicle 102 is in a loaded position within the elevator car 124. That is, each cabin projection 172 may engage the respective supports 182 and each bogie projection 176 may engage the guide 184. For example, each cabin projection 172 may be disposed within an angle formed by the first portion 208 and the second portion 210 of the respective support 182. In the loaded position, each cabin projection 172 may or may not be in contact with the respective support 182. Furthermore, the elevator actuator 212 may be operated such that the ride vehicle 102 is substantially parallel to the ground. This configuration of the attraction system 100 may be considered a "loaded position" for the ride vehicle 102 in the elevator car 124. In the loaded position, the elevator actuator 212 supports the elevator base 150 to be substantially perpendicular with the frame 156. Furthermore, the cabin 106 may be positioned (e.g., by the motion base 114) such that the cabin projections 172 are captured by the first portion 208 and/or second portion 210 of the respective supports 182.

In a certain embodiment, the ride vehicle 102 may be configured to be secured within the elevator car 124. In other words, the ride vehicle 102 may be configured to avoid movement that would cause the ride vehicle 102 to move out of the elevator car 124. In one example, the cabin projections 172 and/or the bogie projections 176 may be configured to lock. As such, movement between the cabin projections 172 and the supports 182 and/or between the bogie projections 176 and the guide 184 may be substantially blocked. In another example, the supports 182 and/or the guide 184 may be configured to adjust to secure the cabin projections 172 and/or the bogie projections 176, respectively. For instance, the first rail 200 and/or the second rail 202 of the guide 184 may be configured to move toward one another and compress against at least a portion of the bogie projections 176. In this manner, the guide 184 blocks movement of the bogie projections 176 along the first rail 200 and/or the second rail 202.

Additionally or alternatively, the supports 182 may adjust a positioning to block movement of the cabin projections 172. By way of example, the first portion 208 and/or the second portion 210 of the supports 182 may be configured to move to decrease an angle between the first portion 208 and the second portion 210. Thus, each first portion 208 and each second portion 210 may compress against the cabin projection 172 to block movement of the cabin projection 172. In a further example, each support 182 may be configured to rotate or otherwise adjust its position along the elevator car sidewalls 180 to block movement of the cabin projection 172 in a particular direction. That is, some of the supports 182 may be configured to rotate 90 degrees in a first rotational direction 230 such that the cabin projections 172 are engaged by the first portion 208 and the second portion 210 to block movement of the cabin projections 172 in the first direction 108. Meanwhile, the position of some of the remainder of the supports 182 may be maintained as shown in FIG. 5 to block movement of the cabin projections 172 in the second direction 110. As such, movement of the cabin 106 in the first direction 108 and the second direction 110 may be blocked.

The ride vehicle 102 may additionally or alternatively be secured within the elevator by components not depicted in FIG. 5. For example, gates may extend across the elevator car sidewalls 180 to block the bogie 112 and/or the cabin 106 from exiting the elevator car 124. Certain components may also be disposed on the cabin 106, the bogie 112, and/or the elevator car 124 (e.g., adjacent to the supports 182 and/or the guide 184) that would block movement of the cabin projections 172 and/or the bogie projections 176.

Figure 6:
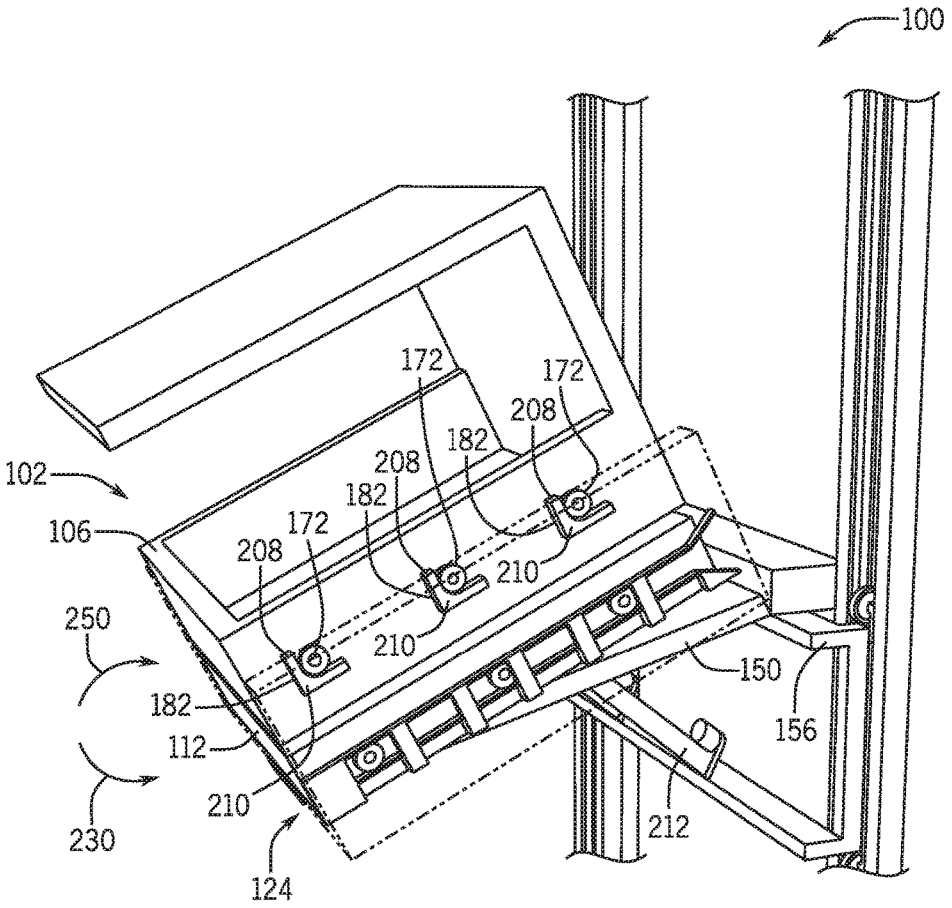
FIG. 6 is a perspective view of an embodiment of the attraction system of FIGS. 1-5, in which the ride vehicle is disposed within the elevator car and the elevator car in a pitched position, in accordance with aspects of the present disclosure.

FIG. 6 is a perspective view of an embodiment of the attraction system 100 in which the elevator actuator 212 is operated to position the elevator base 150 at an angle with respect to the frame 156. For example, the elevator actuator 212 may be a hydraulic actuator, pneumatic actuator, electromechanical actuator, another suitable type of actuator, or any combination thereof, configured to extend and/or retract to adjust the angle between the elevator base 150 and the frame 156. In one embodiment, retraction of the elevator actuator 212 may rotate the elevator base 150 in the first rotational direction 230 to decrease the angle between the elevator base 150 and the frame 156. Moreover, extension of the elevator actuator 212 may rotate the elevator base 150 in a second rotational direction 250 to increase the angle between the elevator base 150 and the frame 156. In a sample embodiment of the attraction system 100, the elevator actuator 212 may be configured to rotate the elevator base 150 to be positioned within a range of angles relative to the frame 156.

Adjusting the position of the elevator base 150 may adjust the cabin 106 to enhance the experience of guests in the cabin 106. In other words, the elevator actuator 212 may cause movement of the cabin 106 that is felt by guests in the cabin 106. Furthermore, in a certain embodiment, positioning the elevator base 150 at an acute angle with respect to the frame 156 may limit a force imparted on the elevator actuator 212. That is, decreasing the angle between the elevator base 150 and the frame 156 may increase an amount of weight supported by the supports 182 and decrease an amount of weight supported by the elevator actuator 212. In other words, adjusting the angle between the elevator base 150 and the frame 156 may distribute the weight of the ride vehicle 102 more equally between the supports 182 and the elevator actuator 212. As such, a stress placed on the elevator actuator 212 and/or the supports 182 may be limited. In a certain implementation, the amount that the elevator actuator 212 rotates the elevator base 150 relative to the frame 156 may depend on an operating parameter of the attraction system 100, such as a weight of the ride vehicle 102 exerted on the elevator actuator 212, a speed at which the ride vehicle 102 is traveling along the elevator path 122, an acceleration of the ride vehicle 102 along the elevator path 122, and so forth. In addition, although FIG. 6 depicts the elevator actuator 212 as positioning the elevator base 150 at an acute angle with respect to the frame 156, it should be understood that additionally or alternatively, the elevator actuator 212 may be configured to position the elevator base 150 at an obtuse angle with respect to the frame 156. Furthermore, the supports 182 may cradle the cabin projections 172 to support the ride vehicle 102, and may limit an amount of stress or pressure that may be exerted onto the actuators of the motion base 114 to support the ride vehicle 102. That is, the engagement of the respective first portion 208 and the second portion 210 of the supports 182 with the respective cabin projections 172 may restrict or limit movement of the ride vehicle 102 relative to the bogie 112 when the elevator base 150 at an angle with respect to the frame 156.

It should be understood that the elevator car 124 may be configured to travel along the elevator path 122 when the cabin 106 is positioned in any manner as depicted in FIGS. 4-6. In other words, the elevator car 124 may be configured to move along the elevator path 122 when the cabin 106 is being adjusted relative to the bogie 112 as shown in FIG. 4, when the cabin 106 is in the loaded position as shown in FIG. 5, when the elevator base 150 is positioned at a particular angle with respect to the frame as shown in FIG. 6, or any combination thereof.

Figure 7:
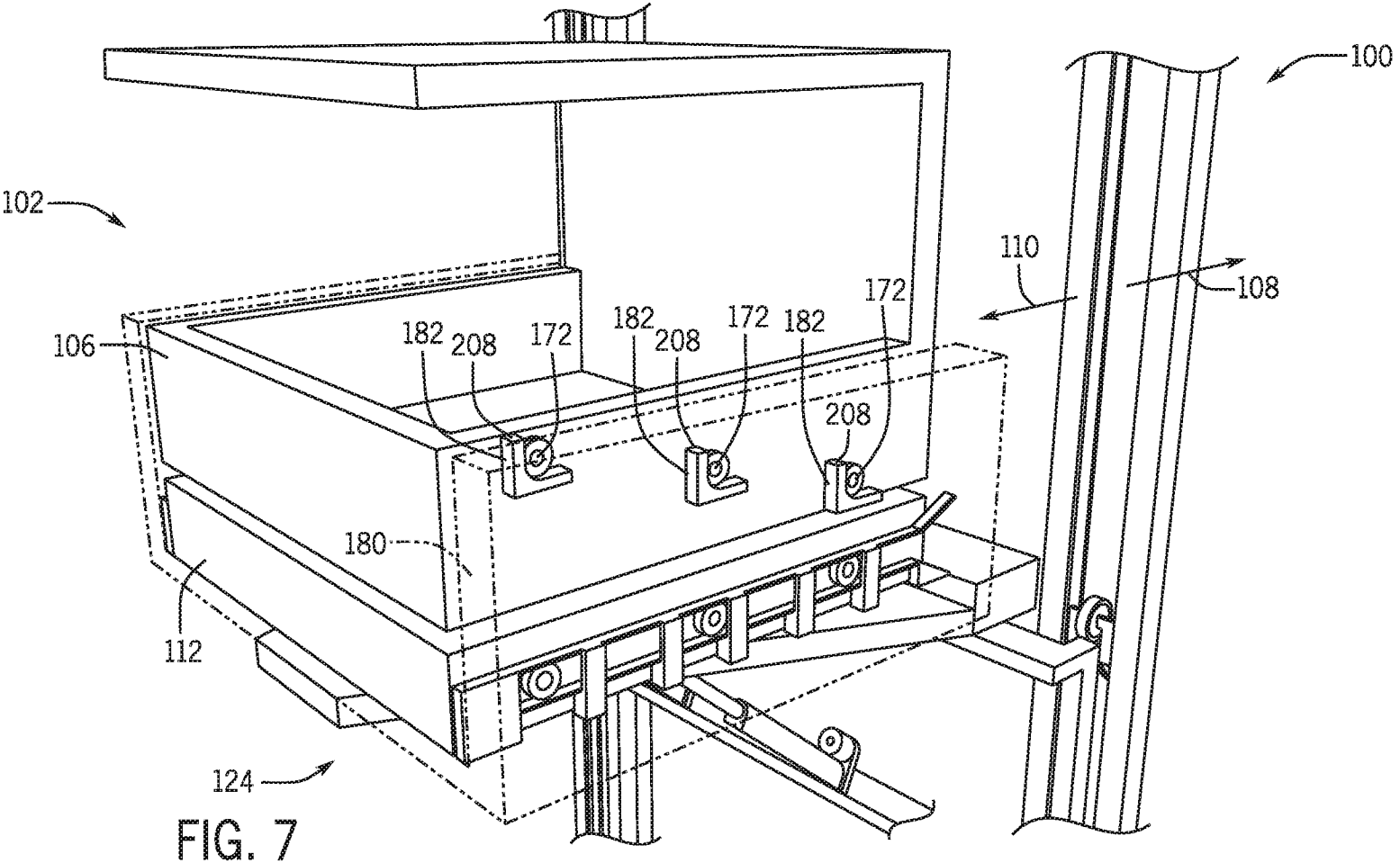
FIG. 7 is a perspective view of an embodiment of the attraction system of FIG. 1, having offset supports and cabin projections, in accordance with aspects of the present disclosure.

FIG. 7 is a perspective view of an embodiment of the attraction system 100 in which the supports 182 and cabin projections 172 are offset from one another. In one embodiment, the supports 182 may be positioned along the elevator car sidewalls 180 that enable the ride vehicle 102 to be inserted into the elevator car 124 the motion base 114 actuating the cabin 106 relative to the bogie 112. That is, the supports 182 may be positioned such that the first portions 208 of each respective support 182 do not overlap one another with respect to the path of travel (e.g., the first direction 108 and/or the second direction 110) of the ride vehicle 102. As such, the motion base 114 may maintain a position of the cabin 106 with respect to the bogie 112 as the ride vehicle 102 is inserted into the elevator car 124.

Figure 8:
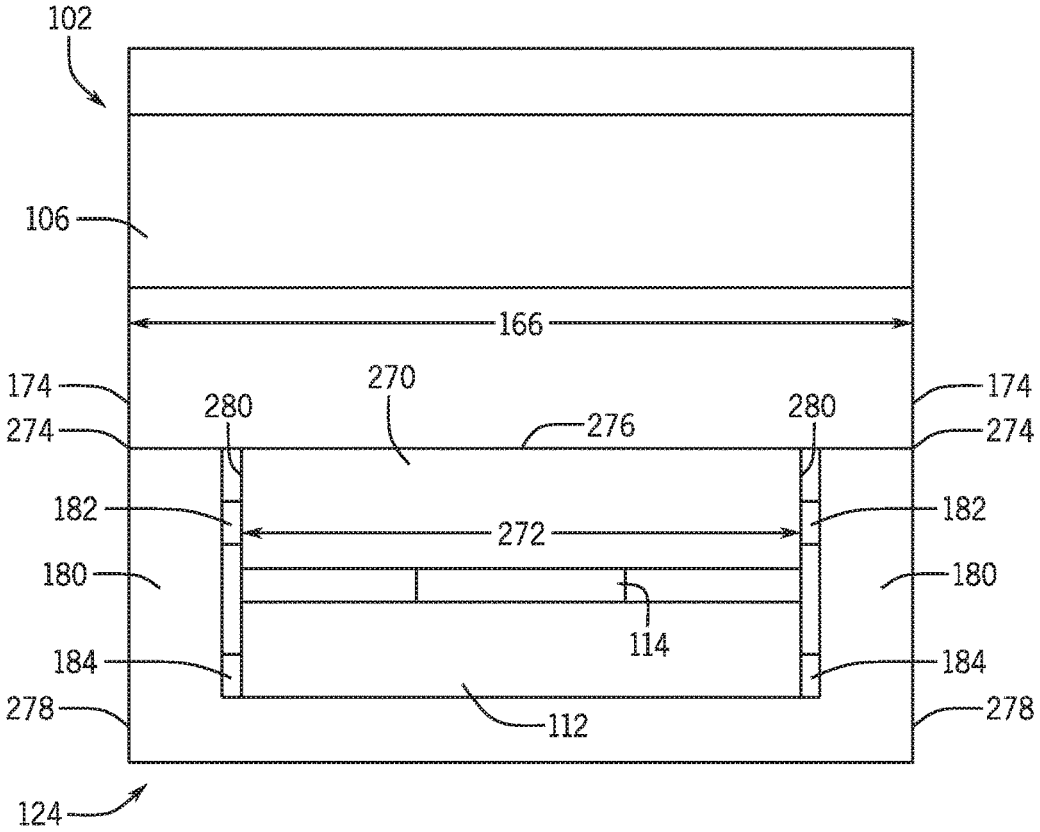
FIG. 8 is a front view of an embodiment of the attraction system of FIG. 1, in which the ride vehicle is in a loaded position within the elevator car, in accordance with aspects of the present disclosure.

FIG. 8 is a front view of an embodiment of the ride vehicle 102 in the loaded position within the elevator car 124. In the illustrated embodiment, the ride vehicle 102 includes an intermediate component 270 coupling the motion base 114 with the cabin 106. A width 272 of the intermediate component 270 may be less than the width 166 of the cabin 106. Furthermore, the bogie 112 may be sized to include the same width 272 as the intermediate component 270. The elevator car 124 may also be sized such that, when the ride vehicle 102 enters the elevator car 124, the bogie 112, the motion base 114, and the intermediate component 270 are each inserted between the elevator car sidewalls 180 while the cabin 106 remains external (e.g., above) to the elevator car 124. For example, a bottom surface 274 of the cabin 106 may abut or be adjacent to a top surface 276 of the elevator car sidewalls 180 when the ride vehicle is in the elevator car 124. In one embodiment, the width 272 may be sized such that an external surface 278 of the elevator car sidewalls 180 may be substantially flush with the cabin sidewalls 174.

Since the intermediate component 270 is positioned within the elevator car sidewalls 180, the cabin projections 172 may be disposed on sidewalls 280 of the intermediate component 270 instead of the cabin sidewalls 174. Thus, the cabin projections 172 may still engage with the supports 182 disposed on the cabin sidewalls 174 when the ride vehicle 102 is in the loaded position. In one embodiment, the supports 182 may be positioned in the manner depicted in FIGS. 2-6, which is in a generally aligned configuration. As such, when the ride vehicle enters or exits the elevator car 124, the motion base 114 may adjust both the intermediate component 270 and the cabin 106 such that the supports 182 are no longer in the path of travel of the ride vehicle 102. Furthermore, the bogie 112 may still include the bogie projections 176 and the elevator car sidewalls 180 may include the guides 184. Thus, the bogie projections 176 may engage with the guides 184 when the ride vehicle 102 is positioned within the elevator car 124.

In the embodiment of FIG. 8, guests in the cabin 106 may not be able to view the elevator car 124. As such, when the ride vehicle 102 enters the elevator car 124, guests may experience a sense that the ride vehicle 102 is "floating" in the elevator assembly 116, rather than being enclosed in the elevator car 124. Thus, the illustrated embodiment may provide a sense of "free-fall" when the elevator car 124 is in motion and increase a thrill or excitement level of the guests.

Figure 9:
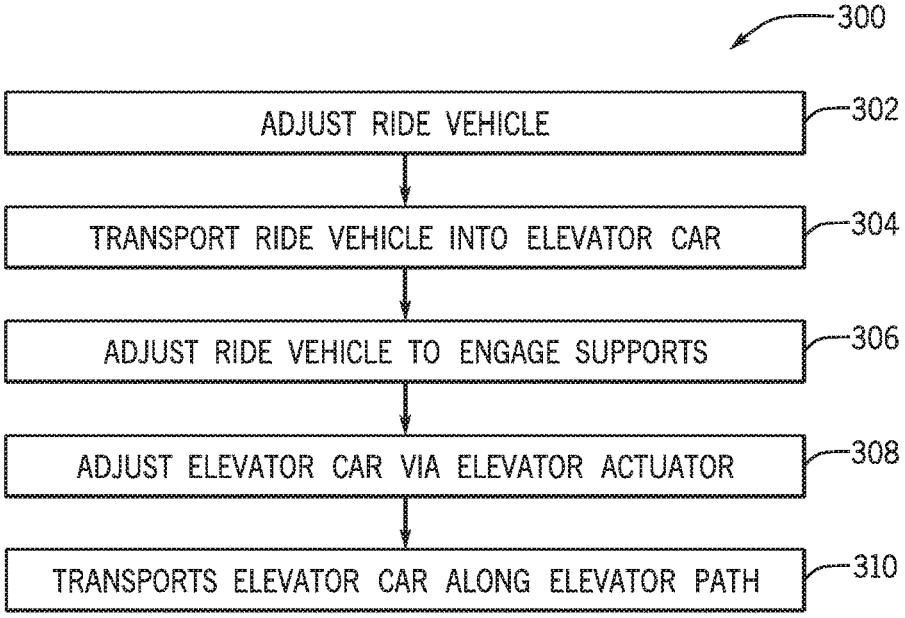
FIG. 9 is a flow chart of a process for operating the attraction system of FIG. 1 to receive the ride vehicle and transport the ride vehicle via the elevator car, in accordance with aspects of the present disclosure.

FIG. 9 is a block diagram illustrating a process 300 for operating the attraction system of FIG. 1 to receive the ride vehicle and transport the ride vehicle via the elevator car. The process 300 may be performed by the control system of the attraction system. For example, the control system may be pre-programmed to perform the process 300. In another example, the control system may be configured to perform the process 300 based on certain operating parameters detected by sensors of the attraction system. In a further example, the control system may be configured to perform the process 300 in response to a user input, such as from an operator of the attraction system. Additionally, as will be appreciated, although the process 300 describes transporting the ride vehicle into the elevator car, a method similar to the process 300 may be used to transport the ride vehicle out of the elevator car.

At block 302, the ride vehicle is prepared for entry into the elevator car. Particularly, the cabin of the ride vehicle may be positioned (e.g., via the motion base) such that the supports of the elevator car are not in the path of travel of the cabin projections. To this end, the motion base of the ride vehicle may extend, pitch, roll, and so forth, to enable the cabin of the ride vehicle to be transported into the elevator car without the supports obstructing the cabin projections. In a sample embodiment, as the ride vehicle is prepared for entry into the elevator car, the elevator car may be prepared to receive the ride vehicle. That is, the elevator car may be positioned on the elevator path and angled with respect to the frame (e.g., via the elevator actuator) to enable the ride vehicle to smoothly enter the elevator car.

At block 304, the ride vehicle is transported into the elevator car. That is, the ride vehicle may move into the elevator car at a target speed and/or a target position to enable the bogie projections to engage with the guides of the elevator car. In a certain embodiment, the motion base may continue to move the cabin relative to the bogie to induce sensations of guests within the cabin. However, the position of the elevator car may be maintained with respect to the elevator path and/or with respect to the frame while the ride vehicle is entering the elevator car.

At block 306, the cabin may be actuated to engage the cabin projections with the supports of the elevator car (block 306). That is, the motion base may adjust (e.g., retract) the cabin to a target position and/or at a target speed to engage each of the cabin projections to be captured or cradled on at least two sides of each respective support. As previously mentioned, such a position of the cabin may be considered the loaded position of the ride vehicle.

At block 308, the elevator actuator may be actuated to adjust the position of the elevator car. That is, the elevator actuator may rotate the elevator car with respect to the frame and/or the elevator path to a target position and/or at a target rotational speed. In this manner, the weight of the elevator car may be better distributed between the elevator actuator, the supports, and/or the guides. As an example, the elevator actuator may decrease the angle between the elevator car and the frame to decrease the weight of the elevator car exhibited on the elevator actuator and increase the weight of the elevator car exhibited on the support and/or the guides. Such an adjustment of the elevator car may avoid placing undesirable stress on a component (e.g., the motion base) of the attraction system, which may increase a longevity of the attraction system.

At block 310, the elevator car may be transported along the elevator path after the elevator car has been adjusted. In an embodiment, the elevator car may be transported at a steady or target speed along the elevator path. For example, the elevator car may be transported to a target elevation in the attraction system, such as to another path of the attraction system. In an additional or an alternative embodiment, the elevator car may be driven at different speeds along the elevator path. In one example, the elevator car may be permitted to free fall along the elevator path. In another example, the elevator car may be accelerated across the elevator path, such as downwards at an acceleration higher than an acceleration caused by gravity.

It should be appreciated that certain steps not described in FIG. 9 may be performed in the process 300. For instance, additional steps may be performed prior to the steps of block 302, after the steps of block 310, or between any of the steps of the process 300. In one example, between blocks 304 and 306, the cabin may be further adjusted. In other words, when the ride vehicle is within the elevator car, the motion base may move the cabin relative to the bogie without engaging the cabin projections with the supports. Other suitable variations of the process 300 may also be performed, as it should be understood that the process 300 provides a general overview for transporting the ride vehicle. A process having steps similar to that of the process 300 may be performed such that the ride vehicle exits the elevator car onto a ride path. For example, the elevator actuator may actuate and rotate the elevator car to be at a suitable angle with the ride path. The motion base may then adjust the ride vehicle such that the cabin projections disengage with and clear the supports. The ride vehicle may then be transported to exit the elevator car.

The present disclosure may provide technical effects beneficial to attractions of an amusement park. In one embodiment, the attraction may include an elevator having an elevator car configured to transport a ride vehicle to different levels or sections of the attraction. Additionally, as the elevator car transports the ride vehicle, the elevator may be configured to pitch the ride vehicle at different angles, while the ride vehicle may additionally move (e.g., heave, surge, roll, pitch, yaw) relative to the elevator car. Such movement of the ride vehicle may generate sensations for guests of the ride vehicle that would otherwise be limited or constrained by existing ride paths to which the ride vehicle may travel along. Thus, the present disclosure may enhance the guest experience of the attractions.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An attraction system, comprising:

an elevator assembly comprising an elevator path, wherein the elevator path intersects a ride path of the attraction system;

an elevator car comprising a support, wherein the elevator car is configured to travel along the elevator path;

a ride vehicle comprising a cabin coupled to a bogie, wherein the ride vehicle is configured to travel along the ride path via the bogie, wherein the bogie is configured to travel into the elevator car via the ride path; and a cabin projection of the cabin, wherein the support is configured to capture the cabin projection on at least two sides when the ride vehicle is in a loaded position.

2. The attraction system of claim 1, wherein the ride vehicle comprises a motion base disposed between the cabin and the bogie, wherein the motion base is configured to move the cabin relative to the bogie.

3. The attraction system of claim 1, wherein the elevator path is a track, and wherein the elevator car is coupled to the track via a frame.

4. The attraction system of claim 3, wherein the elevator assembly comprises an elevator actuator, wherein the elevator actuator is configured to rotate the elevator car relative to the frame.

5. The attraction system of claim 1, wherein the elevator car comprises a guide, wherein the bogie of the ride vehicle comprises a bogie projection, wherein the guide is configured to capture the bogie projection of the ride vehicle.

6. The attraction system of claim 1, wherein the support comprises a first portion and a second portion oriented at an angle with one another, wherein the first portion and the second portion are configured to capture the cabin projection when the ride vehicle is in the loaded position.

7. The attraction system of claim 1, wherein the elevator path intersects an additional ride path of the attraction system, and wherein the ride vehicle is configured to exit from the elevator car onto the additional ride path.

8. The attraction system of claim 1, comprising actuators disposed on the elevator car and the ride vehicle, wherein the actuators are communicatively coupled to a control system of the attraction system, and wherein the control system is configured to instruct the actuators to drive the elevator car along the elevator path, to drive the ride vehicle along the ride path, and/or to move the cabin relative to the bogie.

9. The attraction system of claim 1, wherein the elevator car comprises a first elevator car sidewall and a second elevator car sidewall positioned a distance from one another, and wherein the cabin and the bogie are configured to be positioned between the first elevator car sidewall and the second elevator car sidewall when the ride vehicle is in the loaded position.

10. The attraction system of claim 9, wherein the support is one of a plurality of supports disposed on the first elevator car sidewall, wherein each support of the plurality of supports is positioned offset from one another on the first elevator car sidewall.

11. A method of operating an attraction system, comprising:

actuating, via a motion base, a cabin of a ride vehicle relative to a bogie of the ride vehicle, wherein the motion base is disposed between the cabin and the bogie, and wherein the cabin comprises a cabin projection and the bogie comprises a bogie projection;

directing the bogie along a ride path of the attraction system to engage the bogie projection with guides of an elevator car; and actuating, via the motion base, the cabin to engage the cabin projection with a support of the elevator car, wherein the ride vehicle is in a loaded position while the support captures the cabin projection on at least two sides.

12. The method of claim 11, wherein actuating the cabin comprises actuating the motion base to orient the cabin such that the support of the elevator car is not in a path of travel of the cabin projection as the bogie is directed along the ride path to engage the bogie projection with the guides.

13. The method of claim 11, comprising actuating, via the motion base, the cabin relative to the bogie while the elevator car is driven along an elevator path.

14. The method of claim 13, wherein actuating the cabin comprises rolling, pitching, yawing, turning, extending, retracting, or any combination thereof, the cabin relative to the bogie via the motion base.

15. The method of claim 11, comprising actuating, via the motion base, the cabin to disengage the cabin projection from the support of the elevator car, and directing the bogie along the ride path of the attraction system to disengage the bogie projection from the guides of the elevator car.

16. The method of claim 11, comprising directing the elevator car along an elevator path of the attraction system.

17. A controller of an attraction system comprises a tangible, non-transitory, computer-readable medium having computer-executable instructions stored thereon that, when executed, cause a processor to:

actuate, via a motion base, a cabin of a ride vehicle relative to a bogie of the ride vehicle, wherein the motion base is disposed between the cabin and the bogie, and wherein the cabin comprises a cabin projection and the bogie comprises a bogie projection;

direct the bogie along a ride path of the attraction system to engage the bogie projection with guides of an elevator car; and actuate, via the motion base, the cabin to engage the cabin projection with a support of the elevator car, wherein the ride vehicle is in a loaded position while the support captures the cabin projection on at least two sides.

18. The controller of claim 17, wherein the instructions, when executed, cause the processor to actuate the cabin, direct the bogie, or both, based on an input from a user, an input from a sensor disposed on the attraction system, or both.

19. The controller of claim 18, wherein the sensor is configured to detect an operating parameter, wherein the operating parameter comprises a position of the ride vehicle in the attraction system, a speed of the ride vehicle relative to the ride path, a time that the attraction system is in operation, or any combination thereof.

20. The attraction system of claim 17, wherein the instructions, when executed, cause the processor to actuate the cabin, direct the bogie, or both, at a target speed, to a target position, or both.

* * * * *